United States Patent [19]

Gordon

[11] 4,063,629

[45] Dec. 20, 1977

[54] COIN CHUTES WITH FUNNEL FOR SELECTION THEREBETWEEN

[75] Inventor: Roger G. Gordon, San Leandro, Calif.

[73] Assignee: Safe Rack, Inc., San Leandro, Calif.

[21] Appl. No.: 731,136

[22] Filed: Oct. 12, 1976

[51] Int. Cl.[2] ..... G07F 11/00

[52] U.S. Cl. ..... 194/1 K; 194/54; 194/97 R

[58] Field of Search ..... 194/1 E, 1 D, 1 K, 1 L, 194/DIG. 1, DIG. 2, DIG. 7, DIG. 15, 97 R, 54, 5 S

[56] References Cited

U.S. PATENT DOCUMENTS

| | | | |
|---|---|---|---|
| 979,596 | 12/1910 | Sullivan | 194/DIG. 2 |
| 1,740,878 | 12/1929 | Slezak | 194/1 K |
| 1,882,261 | 10/1932 | Schofield | 194/DIG. 2 |
| 3,941,227 | 3/1976 | Gordon | 194/1 K |

*Primary Examiner*—Robert B. Reeves
*Assistant Examiner*—David A. Scherbel
*Attorney, Agent, or Firm*—Robert G. Slick

[57] ABSTRACT

A coin box mechanism is provided wherein a simple shift of the parts without the use of tools enables one to set the box for two different denominations or totals. The coin box employs a precise adjusting feature for positioning the coin chutes and locks, and also has a novel anti-theft mechanism.

5 Claims, 13 Drawing Figures

COIN CHUTES WITH FUNNEL FOR SELECTION THEREBETWEEN

SUMMARY OF THE INVENTION

The present invention relates to a coin box mechanism and is generally an improvement over the structure of my U.S. Pat. No. 3,941,227.

In my previous patent, a coin box mechanism was shown having a series of slides for accepting coins in various denominations with a U-shaped locking member which could be changed to a plurality of positions to change the combination of coins necessary to actuate the mechanism. Although said device is a practical coin box mechanism, it did suffer from certain deficiencies. For one thing, it was necessary to manufacture the parts with great precision in order to secure satisfactory working of the release mechanism. Further, under certain circumstances, one could secure the release of the merchandise and then immediately pull on the coin return slot and the coins would be returned, allowing one to obtain a free article of merchandise. Further, said device required some manipulation to change over from one denomination to another.

In accordance with the present invention, an improved coin mechanism is provided having an adjustment feature whereby high precision is not necessary in manufacturing the parts since the final adjustment can be achieved after the parts are assembled merely by turning screws.

Further in accordance with the present invention, an anti-theft provision is built into the coin mechanism so that it is impossible to secure the release of coins through the coin return mechanism after the merchandise slide has been released.

Still further in accordance with the present invention, an improved mechanism is provided wherein it is possible to change from one denomination to another by a simple mechanical movement and without the use of tools. Thus, in a typical application, the device might be set up with one denomination of coins for daily papers and another denomination for Sunday papers, and it is easy for the serviceman to shift the mechanism from one denomination to the other.

Various other features and advantages of the invention will be brought out in the balance of the specification.

BRIEF DESCRIPTION OF THE DRAWINGS

In the drawings forming part of this patent application.

DESCRIPTION OF THE PREFERRED EMBODIMENTS

Figures 1, 2, 3:
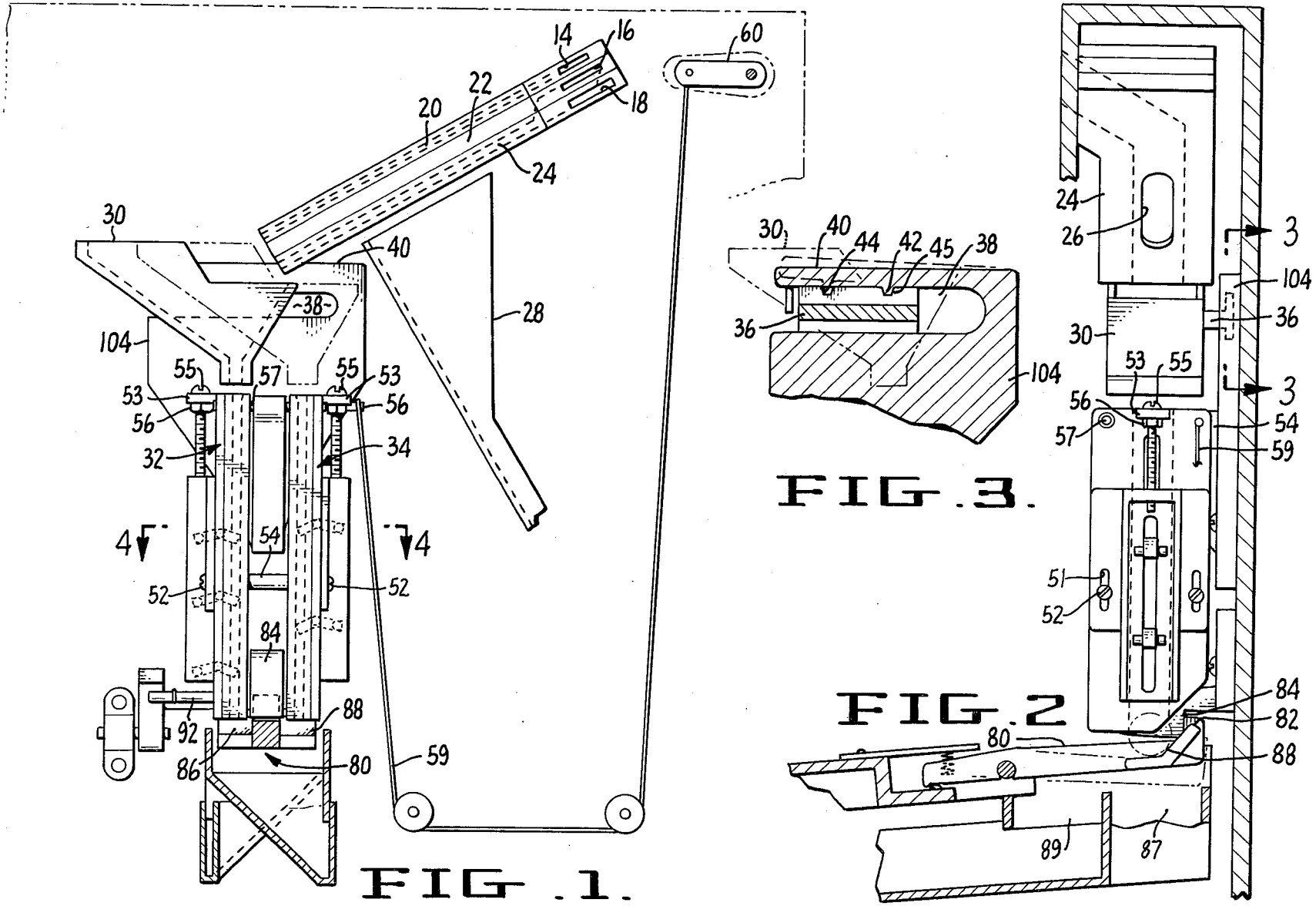
FIG. 1 is a front view, partly in section, of a coin box embodying the present invention.
FIG. 2 is a side view of the coin mechanism.
FIG. 3 is an enlarged partial front view showing the detent action for shifting from one deonomination to another and is a section on the line 3—3 of FIG. 2.
Figure 4:
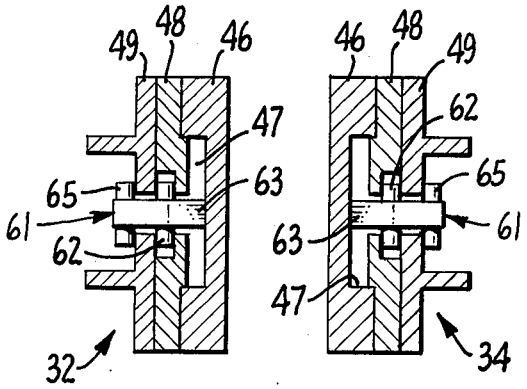
FIG. 4 is a section on the line 4—4 of FIG. 1.
Figure 5:
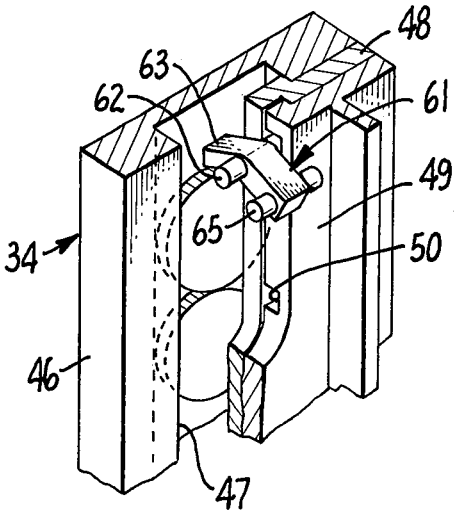
FIG. 5 is an enlarged perspective view, partly in section, of one of the coin retaining devices.

Referring now to the drawings by reference characters, the mechanism includes three coin slots 14, 16 and 18, each adapted to receive a coin of a certain denomination such as dimes, nickels and quarters, respectively. Each leads to a passage respectively 20, 22 and 24, and each of the passages has a slot, such as the one shown in 26, so that if a coin of smaller size is put into that particular slot it will fall through into the defective coin chute 28 for return to the customer. At the end of the slots 20, 22 and 24, a funnel 30 is provided which is situated directly above one of the coin chutes designated 32 and 34. Funnel 30 is mounted on a sliding member 36 which fits into a slot 38 having an upper member 40 of some resiliency. Member 40 has a downwardly extending prong 42, while the member 36 has two detents 44 and 45 and prong 42 can fit into either of these detents. By simply springing the member 40 upwardly, member 36 can be slid back and forth so that the projection 42 goes in one or the other of the two depressions so that the funnel 30 can be positioned directly over either of the coin chute 32 or 34 with a simple movement.

The coin chutes themselves have a slot 48 of such size that a coin in the largest denomination, e.g. quarter, can just pass through the slot.

Coin chutes 32 and 34 are mirror images of each other and therefore only one will be described in detail. Each of the chutes consists of an inner plate 46 having a slot 47 therein. A second plate 48 fits into and over the plate 46 so that the passage which is left is of sufficient size to barely pass a coin of the largest denomination. A third plate 49 is mounted in sliding relationship to plate 46 and 48, and plate 49 has a series of notches 50 therein. Plate 49 has elongated holes 51 therein, through which screws 52 pass into mating holes in plates 46 and 48. These screws pass through spacers 54, and into the opposite set of plates.

Both pairs of plates 46 and 48 are mounted on rod 57 and the assembly is mounted for tilting relationship on bracket 54 attached to the plate 104. Screws 55 extend downwardly from ears 53 into threaded openings in the outer plates 49 and are provided with lock nuts 56. Plate 104 forms part of the back of the mechanism Cord 59 extends from the coin chutes to a handle 60 so that by pulling on handle 60, the entire coin chute assembly can be tilted, as is later explained in detail.

The coin locking members 61 have a flattened "U" shape and include a pivot shaft 62 which fits into a selected one of the notches 50 in plate 49. The coin locking members have a projection 63 extending into the slot 47 and a counter weight 65. It will be understood that a coin passing downwardly through the slot 47 will tilt the member 61 by contact with the projection 63 so that the coin can pass downwardly. On the other hand, the coin locking members will not allow a coin to pass upwardly.

In such coin operated mechanisms wherein the coin itself acts as the agent to release a slide or similar device, it will be apparent that the coin chutes and the locking devices must be placed with extreme accuracy over the operating mechanism. This is easily achieved with the structure described. One can merely release the screws 52 and move the plate 49 up or down to position the coin locking members 61 to the exact height required. Then one can make an adjustment of the position of the coin chutes 32 and 34 by releasing the nuts 56 on the screws 55 and then turning either or both screws 55 to achieve the exact position desired for the coin locking members. When this is achieved, one merely tightens the nut 56 to hold the entire assembly in place. Thus, it is possible to adjust the position of the coin chutes and also of the coin locking mechanisms within the chutes during the final assembly of the coin mechanism, obviating the need for great precision during the manufacturing operation.

Figure 6A:
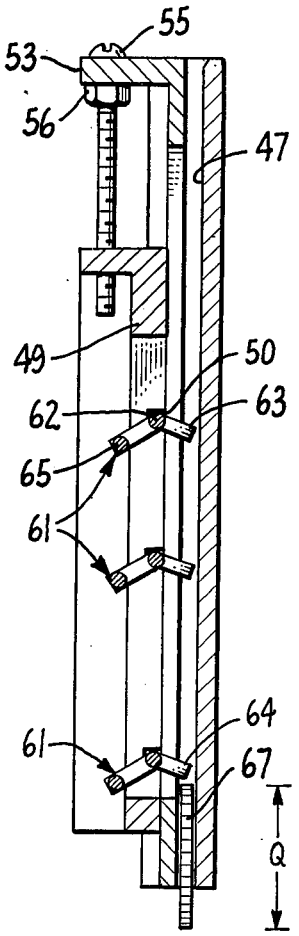
FIGS. 6A, 6B and 6C are front views illustrating how various combinations of coins can be employed to actuate the device.
Figure 6B:
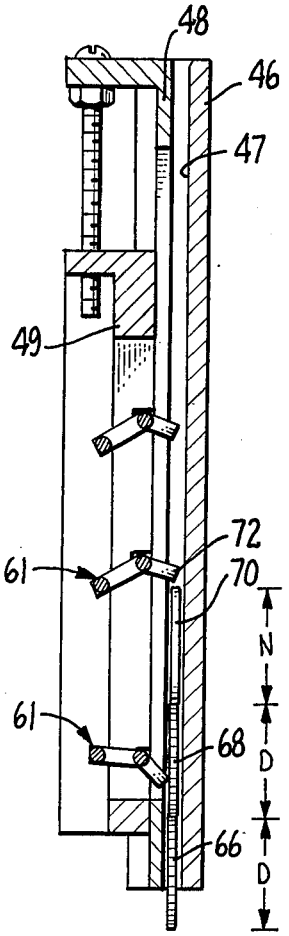
Figure 6C:
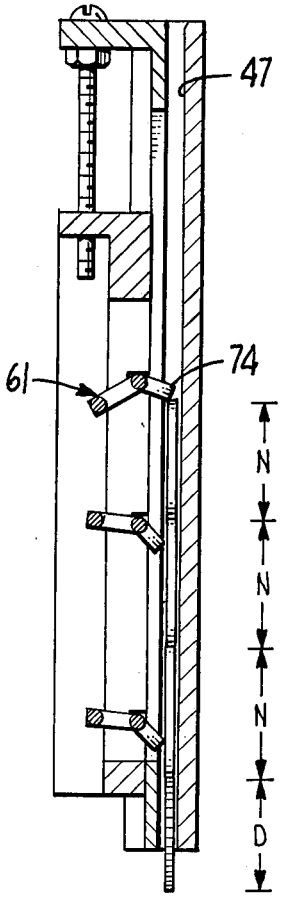

In FIGS. 6A, 6B and 6C, it can be seen how a single slot can accomodate and lock a variety of coins. It will be understood, as previously explained, that members 61 will tilt to allow a coin to pass down into the chute but will lock if there is any upward pressure on the coin. If a coin or coins are in the slot and are locked at their down-most position, they will be capable of actuating the release cam or cams as is later explained. On the other hand, if the coins are not locked in the down-most position, they will not operate the cam but will merely ride upwardly in the slot if one attempts to actuate the cam mechanism. Thus, referring to FIG. 6A, it will be seen that a quarter 67 will lock against the bottom projection 64 so that a single quarter will actuate the machine. In 6B, it is shown how dimes 66 and 68 along with nickel 70 will lock against the second projection 72. Thus, this combination of coins will also actuate the cam. It should be noted that the order in which the coins are in the slot will not alter this so that the nickel can be between the two dimes or at the bottom of the slot and the cam can still be actuated. It should also be noted that two dimes alone would not lock against either of the locking members. In FIG. 6C, it is shown how a dime and three nickels will lock against the top-most projection 74.

Figure 7:
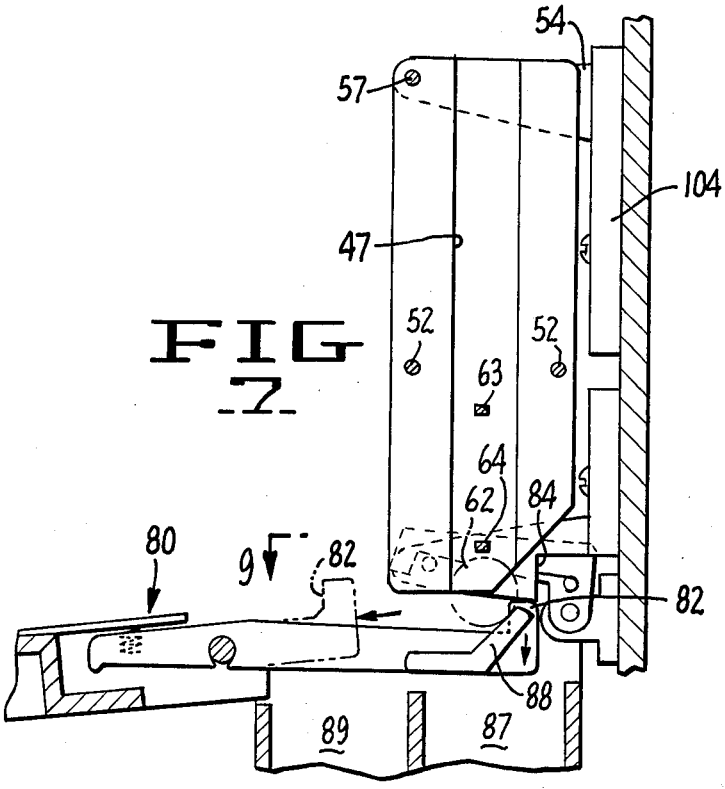
FIG. 7 is a side view showing the action of the slide release mechanism.
Figure 8:
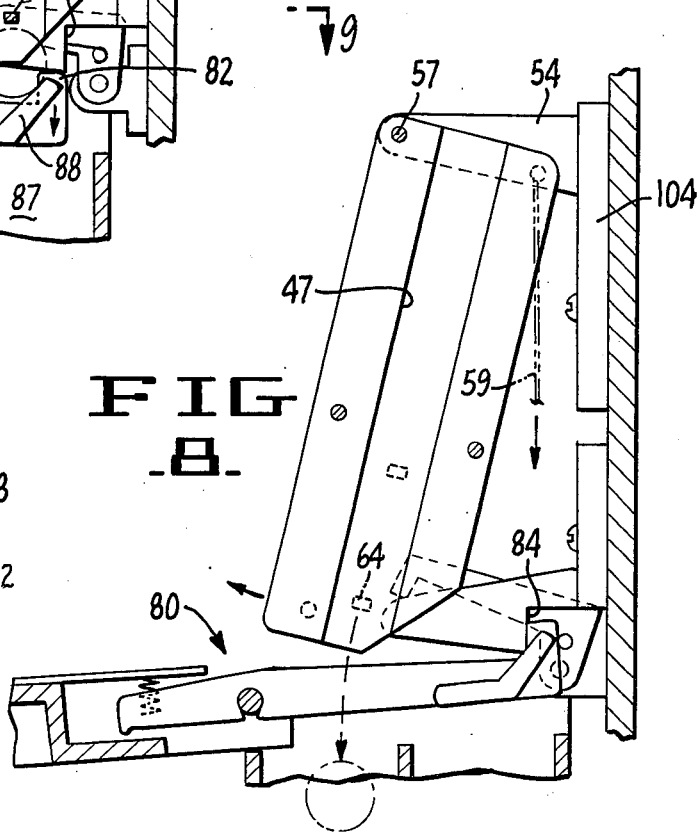
FIG. 8 is a similar side view showing the action of the mechanism during a dispensing operation.
Figure 9:
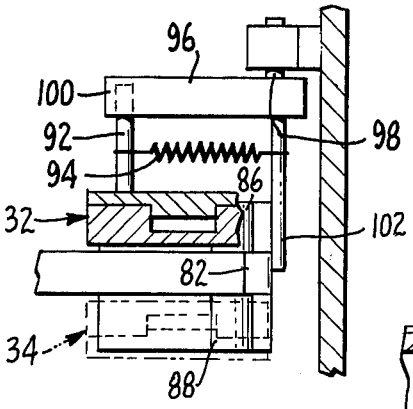
FIG. 9 is a section on the line 9—9 of FIG. 7.
Figure 10:
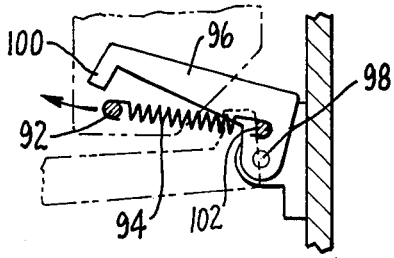
FIG. 10 is a partial view showing the novel anti-theft lock in its open position.
Figure 11:
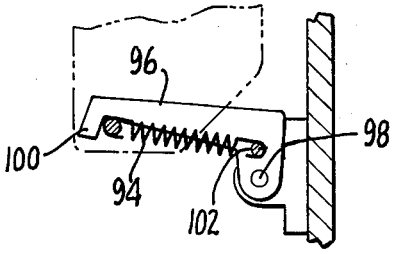
FIG. 11 is a view similar to FIG. 10 showing the lock in its closed position.

The operation of the device will be readily apparent from the drawings and also the description in my previous patent. Thus, the coin device is used with a slide mechanism generally designated 80 which includes a detent 82 which is normally locked against a catch 84. Detent 82 has cams 86 and 88 on either side thereof, and these cams will act against a coin held in the slot to depress the detent 82 and release it from catch 84. This action is best seen by reference to FIG. 7 wherein it is shown that a coin 62 is locked against the projection 64. Now as the slide 80 is pulled to the left, the locked coin will cause the cam member 88 to be depressed downwardly, freeing the detent 82 from catch 84. As the slide moves forward, cam 88 will pass under the coin and the coin will roll over the back of the cam, as is shown by the arrow, and fall into the coin box slot 87.

With the structure previously disclosed, it was found that a skillful cheater could place a coin in the slot, pull the slide sufficiently to unlock the detent 82, and then pull on the coin return mechanism so that the coin, instead of being deposited in slot 87, would be deposited in the coin return slot 89. One improvement of the present invention prevents this from happening in the following manner: In order to prevent such theft, a latch device, best shown in FIGS. 7–11, is employed. This consists of a pin 92 which extends from the coin chute 32 and which is biased towards the rear of the machine by spring 94. A lever arm 96 pivoted at 98 has a downwardly extending tang 100 and also has an abutment 102 which lies against the rear of detent 82. When the slide is to the rear, the parts are in the position shown in FIG. 10 with tang 100 held out of engagement with pin 92 by the pressure from the rear of detent 82. Thus, while the parts are in this position, the coin chutes can be easily swung forward by pulling on the coin return handle 60. After one inserts a coin and the slide is released, the instant slide 80 is moved forward, the pressure on the rear of detent 82 against abutment 102 is relieved, allowing the tang 100 to come down and engage pin 92. This locks the coin chutes against tilting movement. Thus, as the slide barely moves, the coin chute is locked in position, preventing one from actuating the coin return mechanism when the slide has left its extreme rearmost position.

It is believed apparent from the foregoing that I have provided an improved form of coin operated mechanism which does not require high precision and manufacture, which is easy to adjust, easy to change from one denomination of coins to another, and which is substantially incapable of being cheated.

I claim:

1. In a coin operated mechanism having a pair of coin chutes wherein coins of a proper denomination in one of said chutes will release said mechanism, said mechanism including slots in each of said chutes, a U-shaped member adapted to fit into said slot, said U-shaped member having a projection fitting inside the slot and being pivotly mounted at the side of said slot, whereby a coin dropped on said projection will cause said member to tilt and allow a coin to pass but will lock if said coin is moved in the upward direction, and having a slide mechanism including a cam mounted under said coin chutes whereby a coin locked by one of said U-shaped members will depress said cam and allow the slide mechanism to be actuated, the improvement comprising:

a. a funnel-like member mounted over said coin chutes, said funnel-like member having a narrow outlet corresponding in dimensions to one of said chutes;

b. sliding means for said funnel-like member between the two said chutes;

c. two spaced detent means on said sliding means corresponding in location to said chutes, whereby said funnel-like member can be slid from one detent to the other and will be held over the selected one of said chutes.

2. The structure of claim 1 wherein said coin chutes are mounted on a member above said slide mechanism, said member having means whereby it can be adjusted up and down with respect to said slide mechanism.

3. The structure of claim 1 where each of said coin chutes includes a slot for receiving a pivot shaft on said U-shaped member and means for adjusting said slot upwardly and downwardly with respect to said coin chute.

4. The structure of claim 1 wherein said means includes a slotted plate with a set screw therein whereby said slotted plate can be moved up and down with respect to said chute and locked in place with said set screw.

5. The structure of claim 1 wherein said coin chutes are mounted for pivotal motion above said slide whereby said chute can be moved from a first to a second position, said first position representing a slide actuating position and said second position representing a coin return position and locking means actuated by said slide whereby said coin chutes cannot move from said first position to said second position when said locking means is in position, and means for inactivating said locking means when slide is at the rear of said machine.

* * * * *